United States Patent [19]

Noschese et al.

[11] Patent Number: 4,941,833

[45] Date of Patent: Jul. 17, 1990

[54] CONTROLLED IMPEDANCE PLUG AND RECEPTACLE

[75] Inventors: Rocco Noschese, Wilton, Conn.; Michael Lazar, White Plains, N.Y.

[73] Assignee: Burndy Corporation, Norwalk, Conn.

[21] Appl. No.: 254,436

[22] Filed: Oct. 6, 1988

[51] Int. Cl.[5] ..... H01R 4/66

[52] U.S. Cl. ..... 439/92; 439/607

[58] Field of Search ..... 439/63, 92, 94, 607, 439/608, 609, 610, 247, 248, 581, 852, 902, 594, 910

[56] References Cited

U.S. PATENT DOCUMENTS

| | | | |
|---|---|---|---|
| 3,548,365 | 12/1970 | Barker | 439/910 |
| 4,035,047 | 7/1977 | Ammon | 439/78 |
| 4,464,003 | 8/1984 | Goodman et al. | 439/92 X |
| 4,484,792 | 11/1984 | Tengler et al. | 439/607 |
| 4,550,960 | 11/1985 | Asick et al. | 439/61 |
| 4,605,269 | 8/1986 | Cohen, et al. | 439/581 X |
| 4,606,598 | 8/1986 | Drzymkowski et al. | 439/608 |
| 4,641,901 | 2/1987 | Brennan et al. | 439/344 |
| 4,653,837 | 3/1987 | Phillipson et al. | 439/607 |
| 4,737,116 | 4/1988 | Slye et al. | 439/92 |
| 4,767,345 | 8/1988 | Gutter | 439/594 X |
| 4,794,357 | 12/1988 | Foley | 439/92 X |

*Primary Examiner*—William Briggs
*Attorney, Agent, or Firm*—Perman & Green

[57] ABSTRACT

A controlled impedance connector assembly comprised of a mutually engageable plug and receptacle for termination of coaxial cable leads in a manner which enables rapid attachment to and detachment from a user board of a very large number of signal leads while ensuring an acceptable level of controlled impedance from the coaxial cable to the user board. The receptacle includes a backup plate and a plurality of metallized grounding segments fixed to the backup plate and having a plurality of spaced parallel terminal receiving bores therein extending between opposed surfaces. An insulation plate is fixed to each grounding segment and overlies one of the surfaces. A plurality of pin contacts are fixed to the insulation plate such that a head member extends into an associated terminal receiving bore and an oppositely directed tail member is adapted for termination at available circuitry. The plug includes a frame mounting a plurality of dielectric segments each having a plurality of parallel spaced terminal receiving bores extending between a front and a rear face. The dielectric segments are floatingly mounted for movement within defined limits in directions transverse to the axes of the terminal receiving bores.

28 Claims, 11 Drawing Sheets

184
182
186
192
20
108
188
102
96
190
104
110
106
88
98
176
88
88
36
88
194
128
44
48
38
40
50
42
44
54
34
172
46
30
22
174
49
49
26
24

100
96
110
106
102
98
160
168
158
28
170
152
162
138
164
52
166
36
156
167
142
92
94
156
88
90
76
64
56
51
40
58
54
70
204
80
66
60
42
62
82
78
72
202
74
206
208
84
68

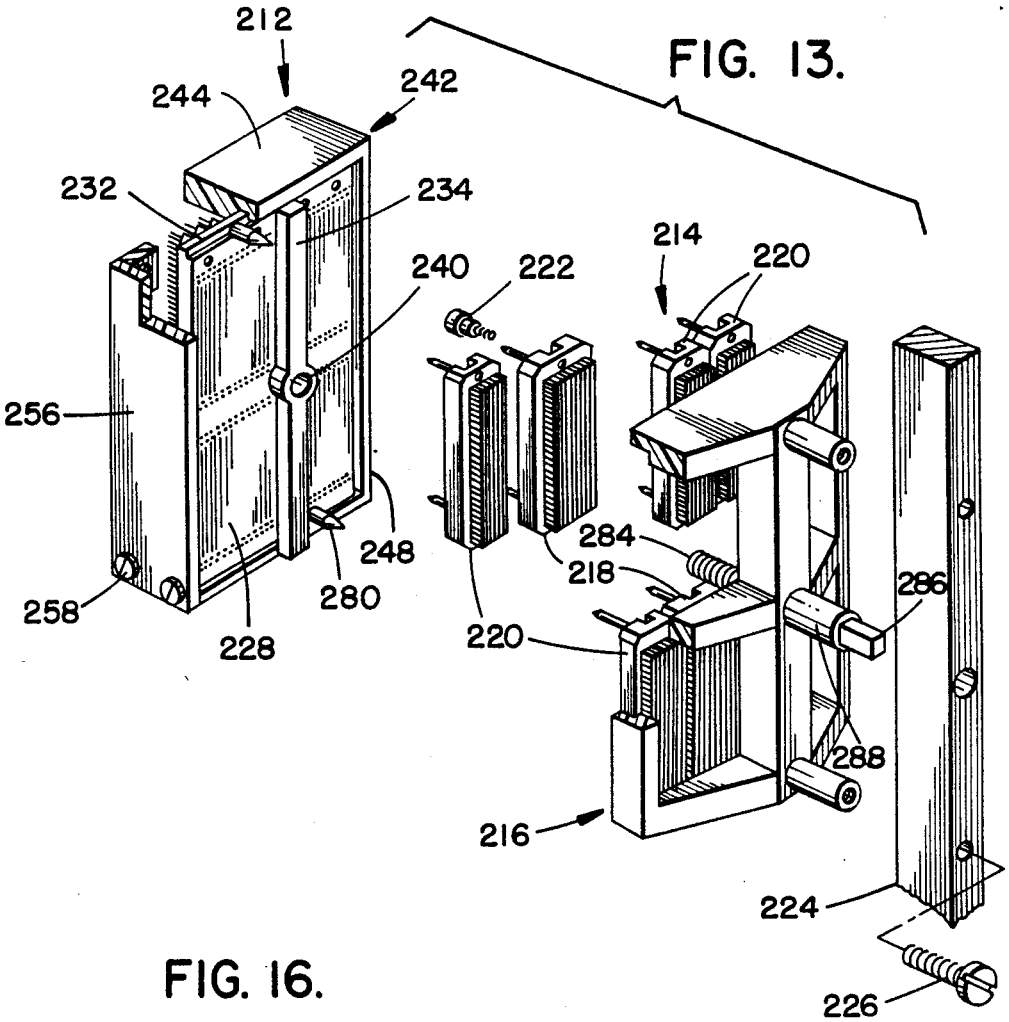
FIG. 13.
FIG. 16.
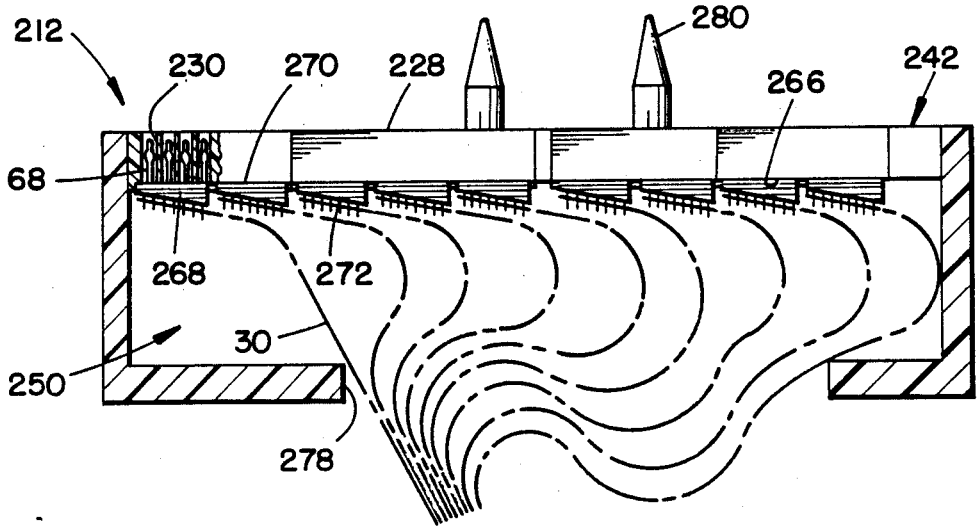

CONTROLLED IMPEDANCE PLUG AND RECEPTACLE

BACKGROUND OF THE INVENTION

I. Field of the Invention

The present invention relates to an electrical connector assembly for termination of coaxial cable leads enabling rapid attachment to and detachment from a user board of a very large number of signal leads while ensuring an acceptable level of controlled impedance from the coaxial cable to the user board.

II. Description of the Prior Art

Requirements of backplane interconnections for electronic data processing and telecommunications applications call for ever increasing densities of electrical leads to accommodate an ever larger number of signals within a given unit of space. At the same time, the space limitations are ever decreasing and this combination has the undesirable effect of increasing noise potential by reason of the increased density of the signal leads. At the same time, it is necessary to maintain a matched impedance from the signal wire, through the region of the interconnection, and into the printed circuit board (PCB) or other form of circuitry with which the signal leads are being terminated. Typical of the problem being faced, and solved, by the present invention is the ability to achieve a standard 50 ohm impedance level for a defined density of leads for which it was only previously possible to obtain a 37 ohm impedance for lead density which was substantially less dense. Previously known small diameter coaxial contacts (for example, contacts having a diameter of 0.100 inches) generally used insulation material for the dielectric. This resulted in a lower impedance value. In contrast, the present invention employs air as the dielectric thereby achieving a higher impedance in a smaller space and utilizes other expedients to achieve positive mating engagement of a very large number of contacts within a limited space.

SUMMARY OF THE INVENTION

The present invention was conceived and has now been reduced to practice to satisfy the more stringent connection requirements referred to above. Thus, a controlled impedance connector assembly is disclosed which is comprised of a mutually engageable plug and receptacle for termination of coaxial cable leads in a manner which enables rapid attachment to and detachment from a user board of a very large number of signal leads while ensuring an acceptable level of controlled impedance from the coaxial cable to the user board.

The receptacle includes a backup plate and a plurality of metalized grounding segments fixed to the backup plate and having a plurality of spaced parallel terminal receiving bores therein extending between opposed surfaces. An insulation plate is fixed to each grounding block and overlies one of the surfaces. A plurality of pin contacts are fixed to the insulation plate such that a head member extends into an associated terminal receiving bore and an oppositely directed tail member is adapted for termination at available circuitry. The plug includes a frame mounting a plurality of dielectric segments each having a plurality of parallel, spaced terminal receiving bores extending between a front and a rear face. The dielectric segments are floatingly mounted for movement within defined limits in directions transverse to the axes of the terminal receiving bores.

A terminal mounted to the extremity of each of a plurality of coaxial leads is removably received in an associated terminal receiving bore with a locking spring being utilized to prevent inadvertent removal of the terminal but subject to manipulation to enable purposeful removal of the terminal. Each bore of the grounding block receives and retains a barrel spring for frictionally holding a terminal in place engaged with the head member of a pin contact. The feature of the grounding segments being integral with the receptacle, rather than with the plug, serves, in part, to reduce the mass of the removable plug and enhances the ease with which it can be manipulated. It also reduces the potential for damage to the spring since the terminal is expected to be manually handled.

The locking spring construction prevents the inadvertent removal of the terminal from its associated terminal receiving bore within its associated dielectric segment while permitting easy purposeful removal of the terminal whenever desired. The use of a plurality of individual dielectric segments for receiving and mounting the coaxial terminals and enabling them to float freely within defined limits substantially improves the ease with which connection between the plug and its mating receptacle can be accomplished. Additionally, the use of the barrel spring placed in a bore of each grounding segment assures mechanical and electrical contact between the terminal, the pin contact, and the grounding block.

With the aid of suitable alignment pins and associated bores, respectively, provided by mating dielectric segments and, similarly, by the frame and the back plate, a jackscrew or other suitable fastener is employed to draw the plug into mating engagement with the receptacle. In the process, the outer conductor of each coaxial terminal is mechanically engaged with its associated barrel spring and, therefore, is electrically coupled to the grounding block. In a similar fashion, the inner conductor of each coaxial terminal is electrically coupled to its associated pin contact. Within each coaxial terminal, air is a primary dielectric between the outer diameter of the inner sleeve and the inner diameter of the outer sleeve and the distance between the two is controlled to thereby maintain a substantially uniform impedance in the region of the connector matched to that of the coaxial cable and of the circuitry to which it is intended to be coupled.

In a typical application, as disclosed, the invention enables simultaneous termination of at least a thousand, or more, coaxial cables mounted in eight floating dielectric segments, each positioned within a very small defined area. By reason of the unique design of the invention, as a connection is made by the plug with its associated receptacle, each of the floating dielectric segments becomes properly positioned with respect to its associated grounding segment as the plug is moved to its final position matingly engaged with the receptacle.

In another embodiment, a plurality of elongated dielectric strips are utilized, adapted for mounting on the grounding block in side by side relationship. Each of the dielectric strips has a plurality of contact receiving bores therein which are in communication with associated terminal receiving bores in the grounding block. Each of the bores in each of the dielectric strips is adapted to supportively receive a pin contact. By reason of this construction, tails of the pin contacts extending out of the contact receiving bores of a dielectric strip can be soldered to appropriate leads of an associated stripline cable at a location remote from the grounding block. After the heat from the soldering operation has sufficiently dissipated, the dielectric strip and its mating stripline cable can be mounted to the grounding block. By so doing, the grounding block does not become a heat sink which might otherwise have a deleterious effect on other components electrically and/or mechanically connected to it.

Other and further features, objects, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated herein and constitute a part of this invention, illustrate some of the embodiments of the invention and, together with a description, serve to explain the principles of the invention in general terms. Like numerals refer to like parts throughout the disclosure.

BRIEF DESCRIPTION OF THE DRAWINGS

FIG. 13 is an exploded perspective view illustrating another embodiment of the invention;

FIG. 16 is a side elevation view, certain parts being cut away and shown in section, of the receptacle illustrated in FIG. 14 in its assembled condition and with the stripline cable of FIG. 15 attached thereto.

DETAILED DESCRIPTION OF THE PREFERRED EMBODIMENTS

Figure 1:
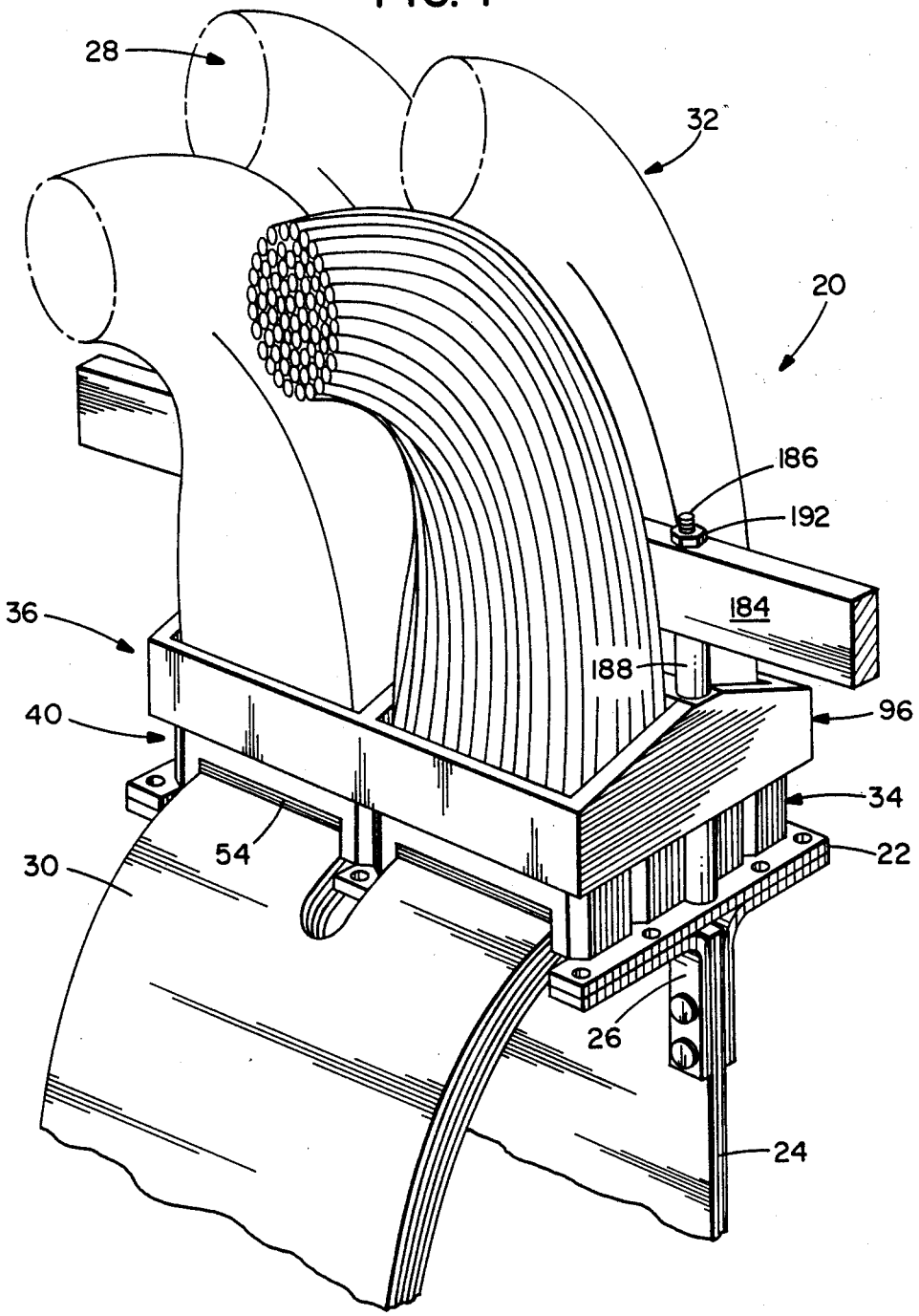
FIG. 1 is a perspective view of a controlled impedance connector assembly which embodies the invention.
Figure 2:
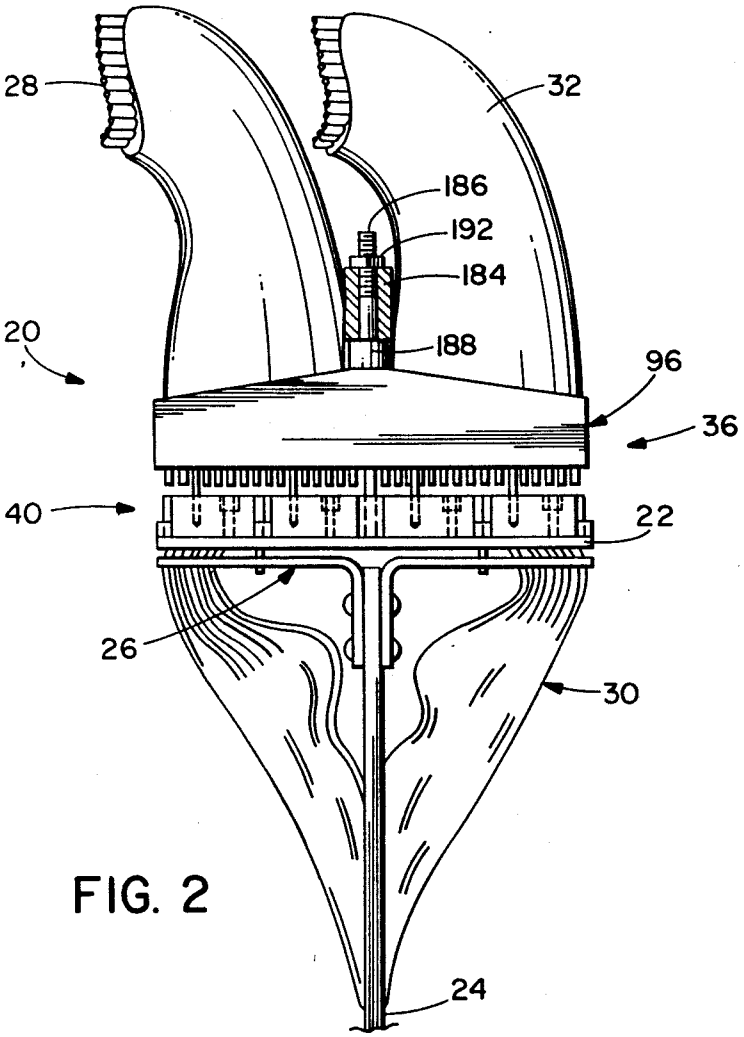
FIG. 2 is a side elevation view of the connector assembly illustrated in FIG. 1.

Turn now to the drawings and initially to FIGS. 1 and 2 which are illustrative of a controlled impedance connector assembly 20 which embodies the invention. In a typical installation, a backup plate 22 is mounted to a logic or user board 24 by means of suitable brackets 26. The arrangement of components is such that electrical signals from a plurality of coaxial leads 28 (FIG. 1) can be transmitted, with minimal interference, through the connector assembly 20 and through stripline cable 30 to appropriate circuitry on the logic board 24. In a typical installation as illustrated, four jacketed bundles 32 of the coaxial leads 28 are electrically and mechanically connected to the stripline cable 30 by means of the connector assembly 20 for appropriate connection to associated circuitry on the logic board 24. Of course, it will be appreciated that the leads 28 might not be jacketed as depicted by one of the bundles in FIG. 1. By being unjacketed, individual leads are able to "go off" in a variety of directions for termination at widely dispersed locations.

Figure 3:
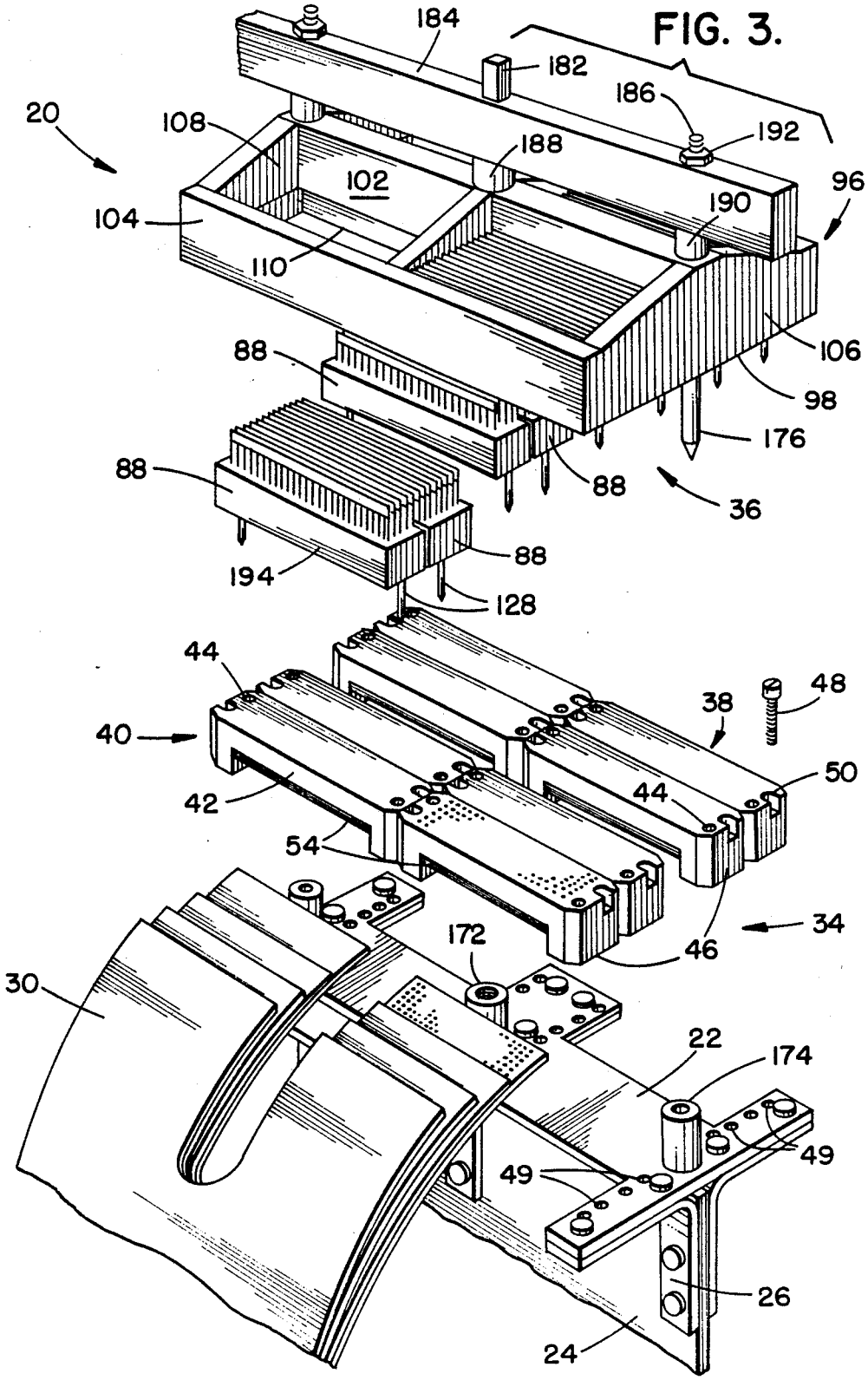
FIG. 3 is an exploded perspective view illustrating most of the components illustrated in FIG. 1.
Figure 4:
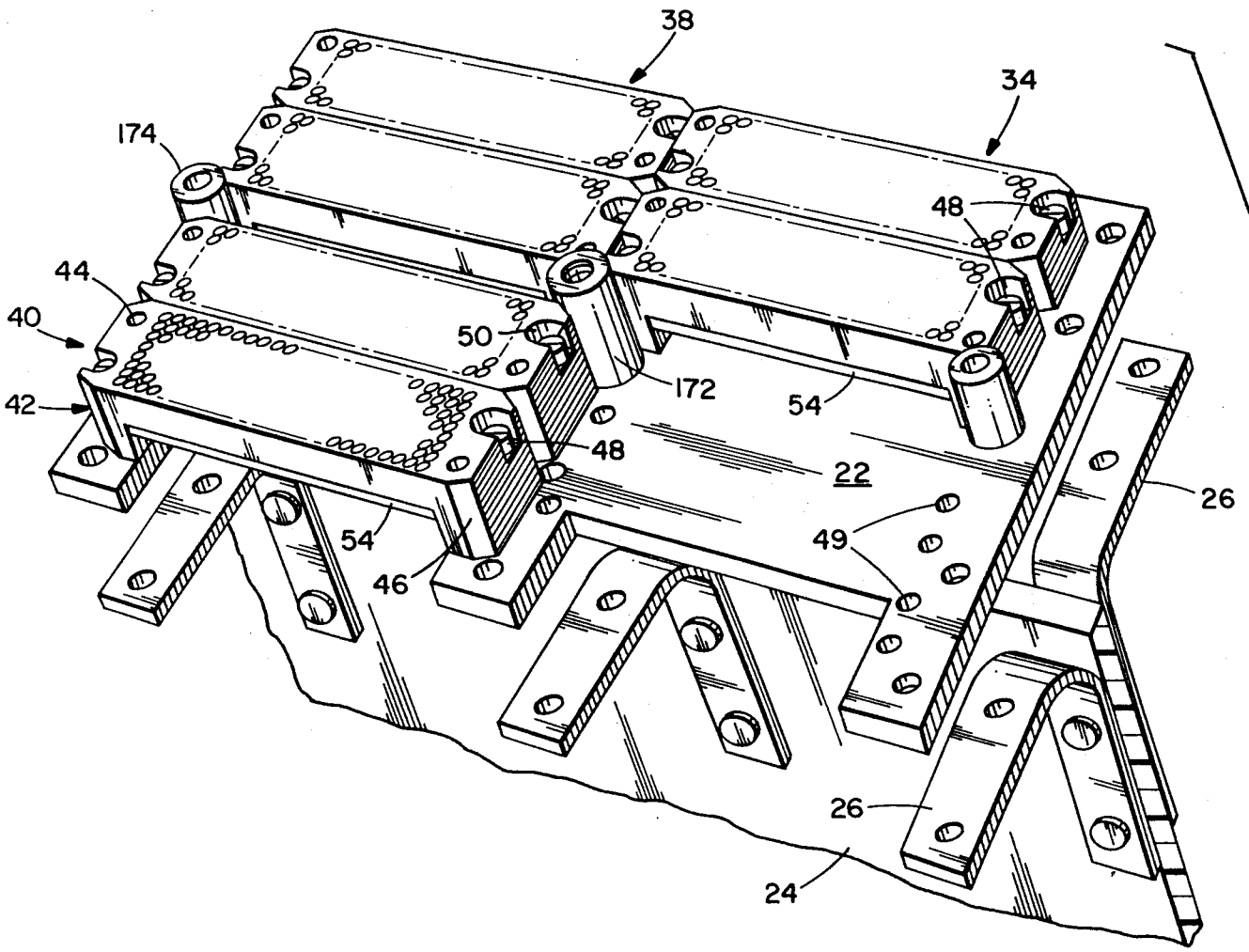
FIG. 4 is a detail perspective view illustrating some of the components illustrated in FIGS. 1, 2, and 3.

The construction about to be described enables a very dense interface of signal leads to associated circuitry and represents a significant advance in the state of the art which could not have been achieved using conventional techniques. To achieve this end, the connector assembly 20 incorporates a unique receptacle 34 and a unique plug 36 matingly engageable with the receptacle. As best seen in FIGS. 3 and 4, the receptacle 34 includes the backup plate 22 previously described as being mounted to the logic board 24 by means of brackets 26. In a typical installation, the backup plate 22 lies in a plane perpendicular, or at least transverse, to the logic board.

In turn, a plurality of metalized grounding blocks 38 are mounted to a surface of the backup plate 22 in an aligned, side by side fashion. The term "metalized is taken to mean that each grounding block may be made from a wide variety of materials which are electrically conductive. Thus, each grounding block may be metal, ceramic or plastic with a metal coating or ceramic or plastic with sufficient embedded metal to render it electrically conductive. In any event, each grounding block 38 may include a plurality of individual ground segments 40 each including a bridge member 42 having a pair of spaced parallel alignment bores 44 therein and a pair of spaced apart support legs 46 integral with and extending transversely from the bridge member. Screws 48 or other suitable fasteners are suitably received in associated recesses 50 at opposite ends of the ground segment for threaded engagement with tapped holes 49 for fixedly mounting each ground segment to the backup plate 22.

Figure 5:
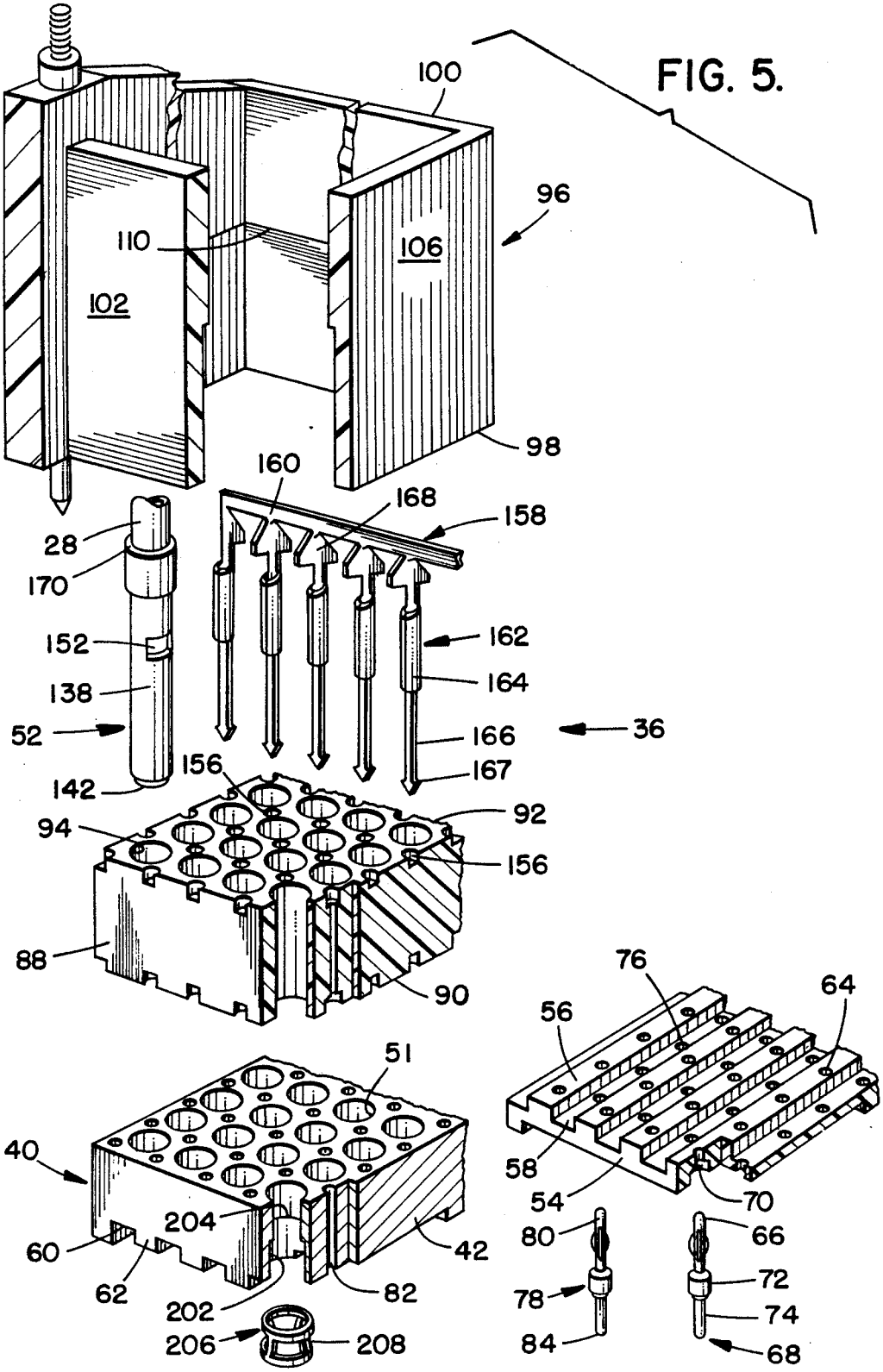
FIG. 5 is a detail exploded perspective view illustrating parts of most of the components illustrated in FIG. 3.
Figure 6:
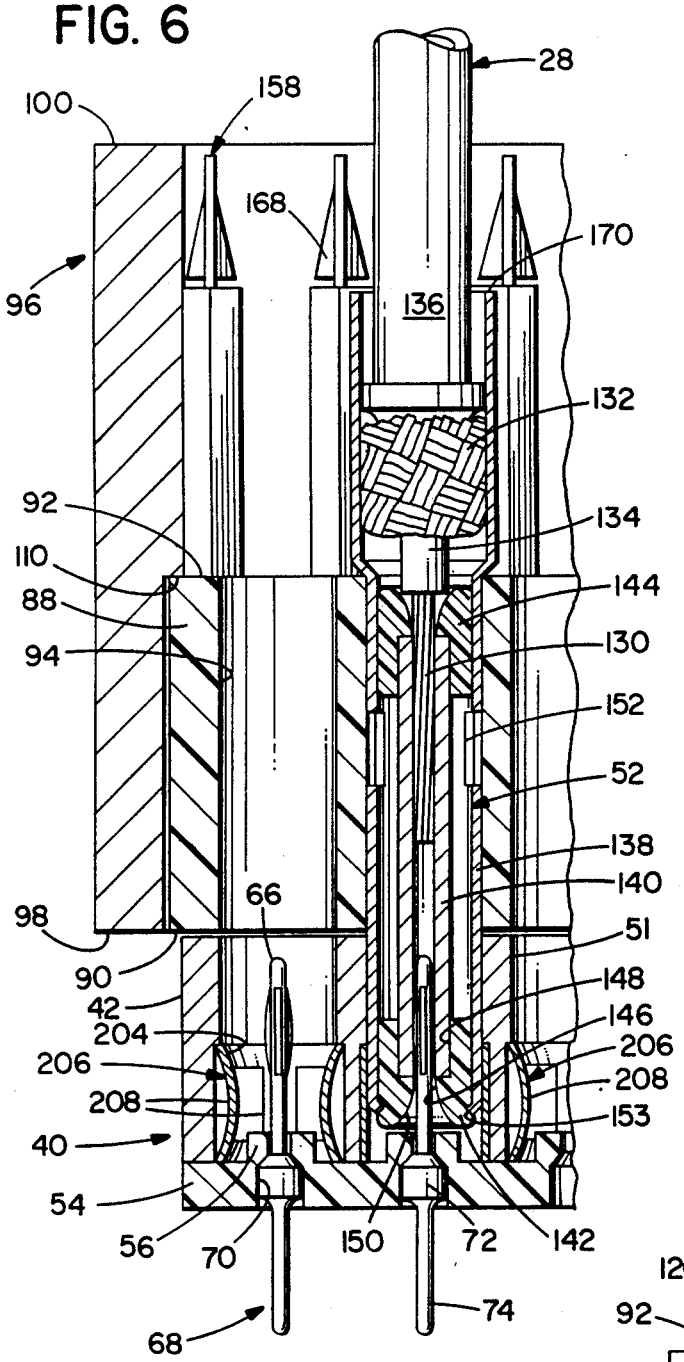
FIG. 6 is a detail side elevation view, substantially in cross section, illustrative of an engaged plug and receptacle forming the connector assembly of the invention.

With particular reference to FIGS. 5 and 6, it is seen that each bridge member 42 has a plurality of spaced parallel receiving bores 51 therein, each bore serving to receive the tip end of an associated terminal 52 at the extremity of an associated coaxial cable lead 28. An insulation plate 54 composed of a suitable dielectric material is fittingly attached to the back side of the bridge member 42 and has a plurality of successive laterally extending ridges 56 and grooves 58 which mate in a fitting manner with associated grooves 60 and ridges 62 formed in the back side of the bridge member 42.

The insulation plate 54 has a plurality of contact receiving bores 64 extending therethrough at spaced locations along each of the ridges 56. In a manner which will be more clearly described subsequently, each bore 64 receives therethrough a nose end 66 of a signal pin contact 68 and is formed with a counterbore 70 suitable to fittingly receive an enlarged base 72 intermediate the nose end and a tail 74 of the contact. In a similar manner, a plurality of contact receiving bores 76 extend transversely through the insulation plate 54 and are generally aligned with the grooves 58. These serve to receive ground pin contacts 78 whose nose ends 80 are engageably received in associated through bores 82 (FIG. 5) in the bridge member 42. Hence, when the insulation plate 54 is mounted on the bridge member 42, the bores 64 are coaxially aligned with the receiving bores 51 and the bores 76 are similarly aligned with the bores 82.

Figure 7:
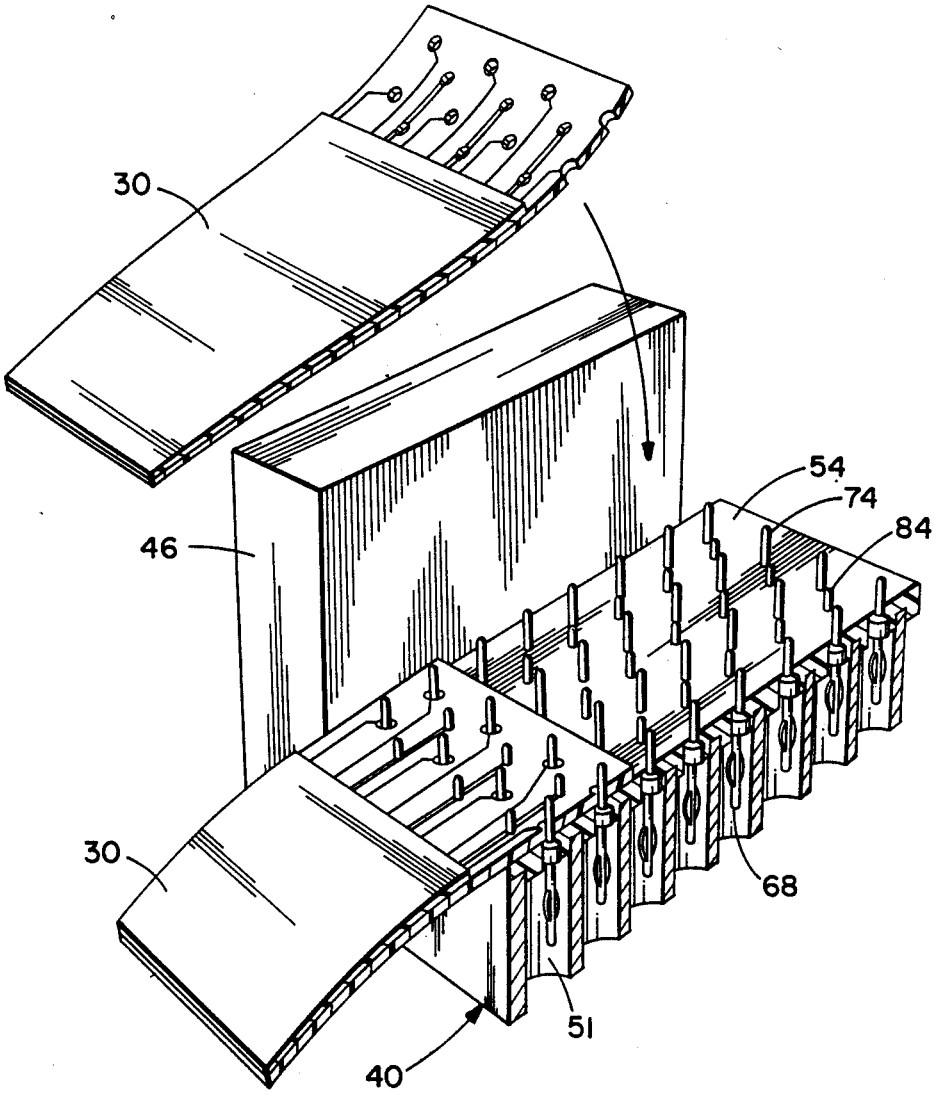
FIG. 7 is a detail perspective view, partially exploded, illustrating the mounting of stripline cable to the underside of the receptacle forming part of the connector assembly.
Figure 8:
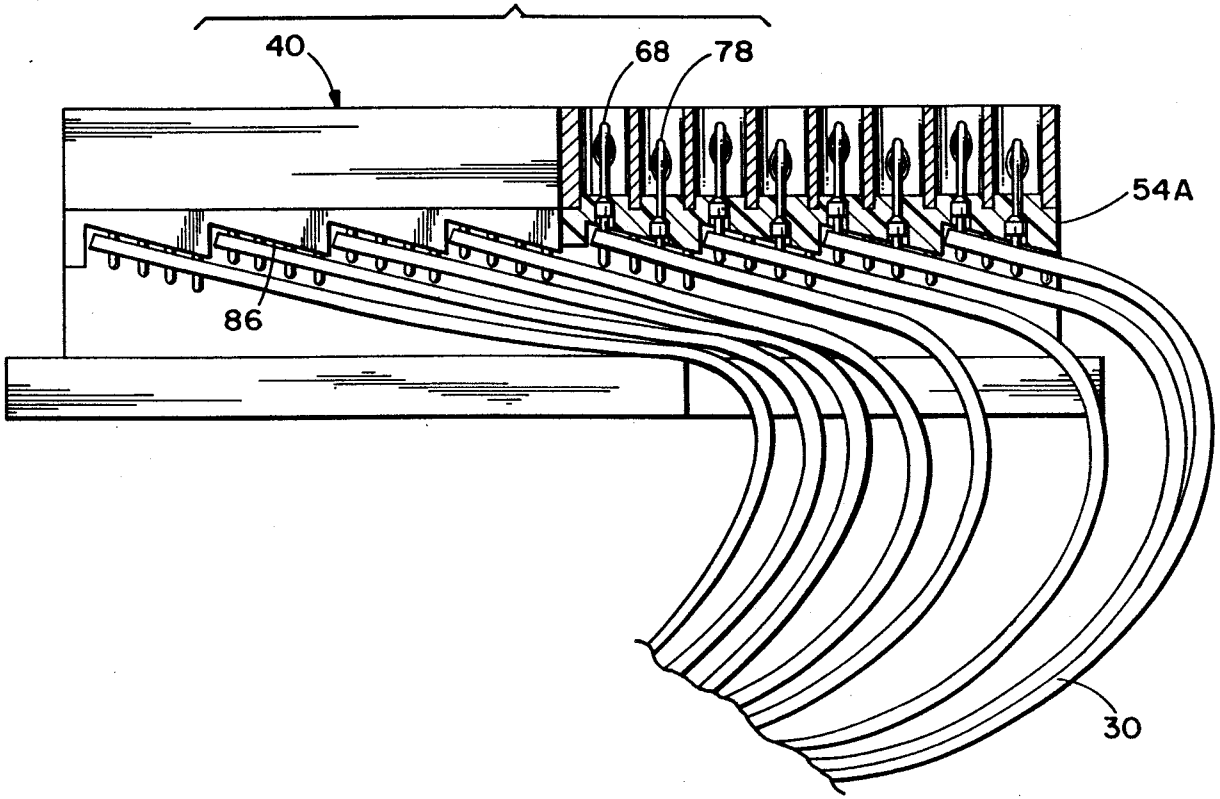
FIG. 8 is a side elevation view illustrating a modified construction of the components illustrated in FIG. 7.

As seen particularly well in FIGS. 7 and 8, the tails 84 of the ground pin contacts 78 and the tails 74 of the signal pin contacts 68 are engaged with appropriate associated apertures in the stripline cable 30 after which they are soldered to the leads on the stripline cable in a suitable manner thereby completing termination of the stripline cable to the receptacle 34. While a back surface of the insulation plate 54 may be substantially planar as illustrated in FIG. 7, a modified construction is illustrated in FIG. 8 in which a back surface of a modified insulation plate 54A is stepped as at 86 in the manner of succeeding saw tooth portions each with a depth substantially equivalent to the thickness of the stripline cable 30. This construction enables the firm attachment of successive cables to the ground segments 40 without interfering with a preceding cable.

Turn now particularly to FIGS. 3, 5, and 6 for a detailed description of the plug 36. As previously mentioned, the plug 36 is intended for mating engagement with the receptacle 34 which, as noted, has a very large number of contact members supported therein. The plug 36 includes a plurality of dielectric segments 88 each of which is substantially coextensive with an associated ground segment 40. Each dielectric segment 88 has a front face 90 and a rear face 92 (see especially FIG. 6) and a plurality of parallel spaced terminal receiving bores 94 extending therethrough.

An additional part of the plug 36 includes a frame 96 utilized for mounting a plurality of dielectric segments 88 as a unit. In the construction illustrated, eight dielectric segments 88 are mounted on the frame 96, although that particular number is not to be limiting of the invention. In the particular construction illustrated, the frame 96 extends between a front side 98 and a rear side 100. It includes a major longitudinal wall 102 and a pair of minor longitudinal walls 104 on either side of the wall 102 lying in parallel spaced apart planes and extending between the front side 98 and the rear side 100. In a similar manner, there are three lateral walls 106 which lie in parallel spaced apart planes which are transverse to and intersect the major longitudinal wall 102, and as with the walls 102 and 104, extend between the front side 98 and the rear side 100. As seen particularly well in FIG. 3, the frame 96 defines four separate compartments 108 with each compartment being bounded by a pair of lateral walls 106, and by the longitudinal walls 102 and 104.

The interior wall surfaces of each of the compartments 108 are formed with a peripheral shelf 110 intermediate the front and rear sides 98 and 100, respectively. This shelf serves to engageably receive outer regions of the rear face 92 of each associated dielectric segment 88 in such a fashion that the front faces 90 of all of the dielectric segments are substantially coplanar when their rear faces are engaged with the shelf.

As illustrated in FIG. 6, it will be noted that the outer dimensions of the dielectric segments 88 are slightly less than the inside dimensions of the compartment 108 both laterally and longitudinally so that there is some range of movement in those directions. At the same time, the dimension of each segment 88 between its front and rear faces 90 and 92, respectively, is substantially equivalent to the distance between the peripheral shelf 110 and the front side 98 of the frame 96.

As seen especially clearly in FIG. 3, a pair of the dielectric segments 88 are associated with and received in each of the compartments 108. However, unlike the ground segments 40 which are fixed to the backup plate 22, the dielectric segments 88 are floatingly mounted on the frame 96. That is, the segments 88 are so mounted to the frame that they have some freedom of movement in all planes of reference. That is, they are movable fore and aft relative to the shelf 110 and the front side 98; they are movable in a longitudinal direction toward and away from the lateral walls 106; and they are movable in a lateral direction toward and away from the longitudinal walls 102, 104.

Figure 10:
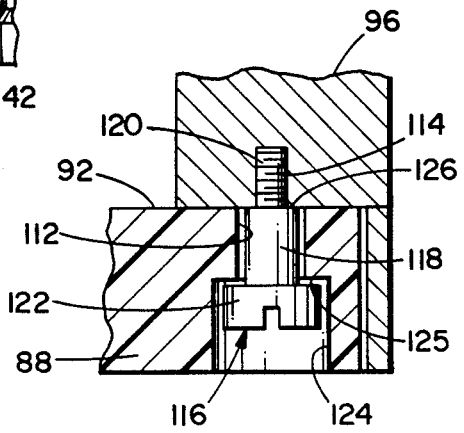
FIG. 10 is a detail elevation view, in section, illustrating a part of the construction shown in FIG. 9.
Figure 9:
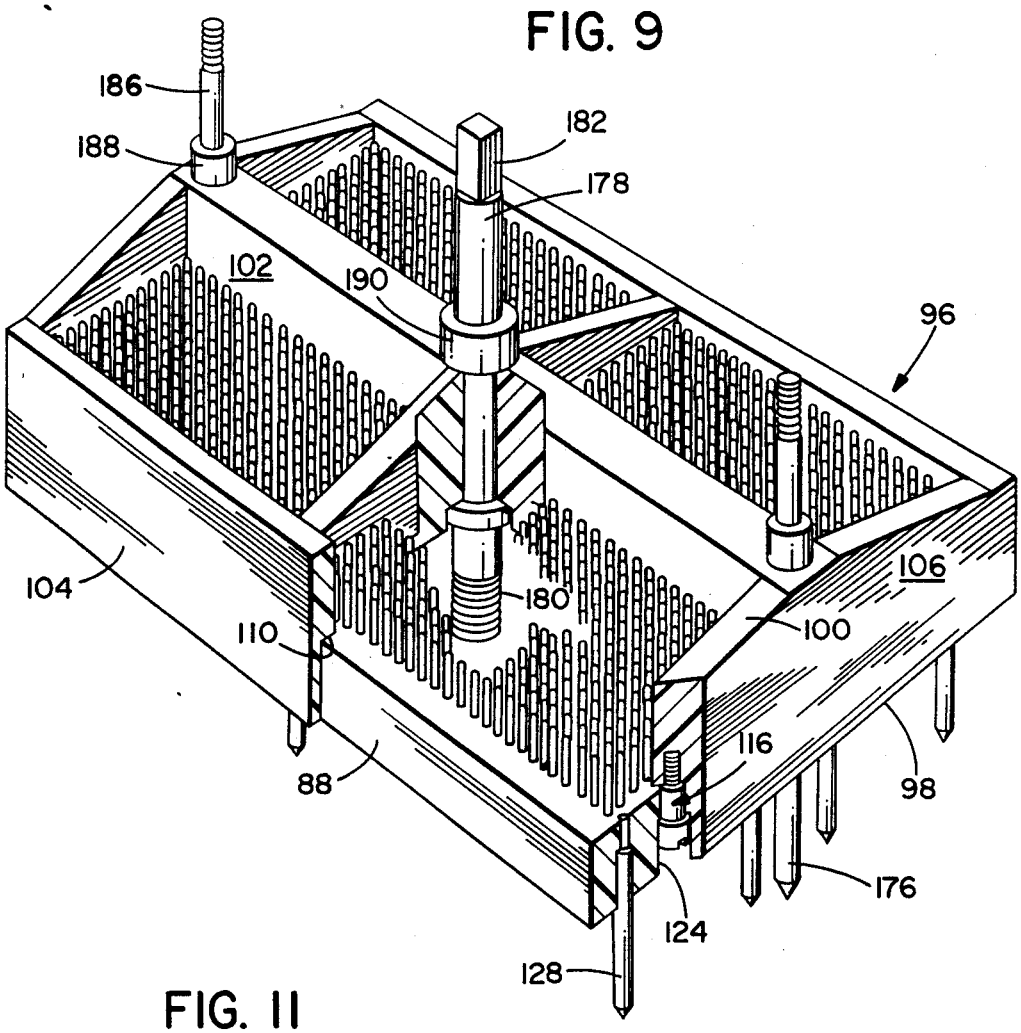
FIG. 9 is a perspective view, certain parts being cut away and shown in section, illustrating the plug utilized with the connector assembly illustrated in FIGS. 1–3.

This capability is achieved by reason of the construction best illustrated in FIGS. 9 and 10. Specifically, each of the dielectric segments 88 has a pair of spaced mounting holes 112 therein and the frame 96 has a pair of spaced tapped holes 114 associated with each of the mounting holes 112. A threaded fastener 116 extends loosely through each mounting hole 112 and is threadedly engaged with the tapped hole 114. Specifically, shank 118 of the fastener extends loosely through the mounting hole 112 and stretches between a threaded end 120 and a head 122 which is slotted to receive an end of a screwdriver. The mounting hole 112 has a counterbore 124 associated therewith for receiving the head 122. When a shoulder 126 defining an interface between the shank 118 and the threaded end 120 engages the frame 96 (FIG. 10), the head 122 is slightly spaced from an annular shelf 125. When this occurs, the segment 88 is substantially prevented from moving in a fore and aft direction. However, by reason of the fact that the diameter of the shank 118 is less than that of the mounting hole 112, the segment 88 does have limited freedom of movement in both the longitudinal and lateral directions.

Additionally, each of the dielectric segments 88 includes a pair of spaced parallel alignment pins 128 which are fixed to and extend from the front face 90. Each alignment pin 128 is slidably receivable in a mating alignment bore 44 in an associated ground segment 40 to which reference has previously been made.

Each dielectric segment 88 serves to support and organize 216 coaxial terminals 52. It will be understood that the number of coaxial terminals is typical but is not controlling of the invention. As particularly well illustrated in FIGS. 6 and 11, each coaxial terminal serves to terminate an individual coaxial cable lead 28 having an inner signal carrying wire 130, an outer conductive shield 132, a dielectric layer 134 intermediate the inner wire 130 and the outer shield 132, and an outermost dielectric covering 136.

The terminal 52 itself includes an elongated tubular electrically conductive outer sleeve 138 which is fixed to the outer conductive shield 132 in a manner to be described. It also includes an inner electrically conductive sleeve 140 which is coaxial with the outer sleeve 138. The signal carrying wire 130 extends into the inner sleeve 140 and the two are also joined together in a manner to be described. Fore and aft bushings 142, 144 of dielectric material may be of similar construction, but oppositely disposed, at longitudinally spaced locations along the terminal 52. The bushings 142, 144 mutually support the outer sleeve 138 and the inner sleeve 140 to hold them fixed relative to one another both longitudinally and radially or laterally.

It is to be noted that it is desired to shield each signal carrying wire 130 from its adjoining signal carrying wires. It is also desired to control the impedance through the coaxial inner and outer sleeve assembly to closely match the impedance of the coaxial cable. By reason of this construction, the exposed wire 130 and its associated sleeve 140 are surrounded by air, an ideal insulating medium. Air is used to provide a low dielectric constant (namely, one) so that a 50 ohm impedance level can be maintained in a smaller diameter outer body. The outer diameter of the outer sleeve 138 may typically be 0.080 inches, although that dimension is not intended to be restrictive of the invention. This construction assures that the terminal 52 possesses the strength necessary to perform its intended function of selectively coupling its associated lead 130 to desired circuitry or uncoupling it from the circuitry while the impedance manifested by the coaxial terminal 52 is substantially matched to that of the coaxial cable lead 28 and to such circuitry to which it might be coupled.

Figure 11:
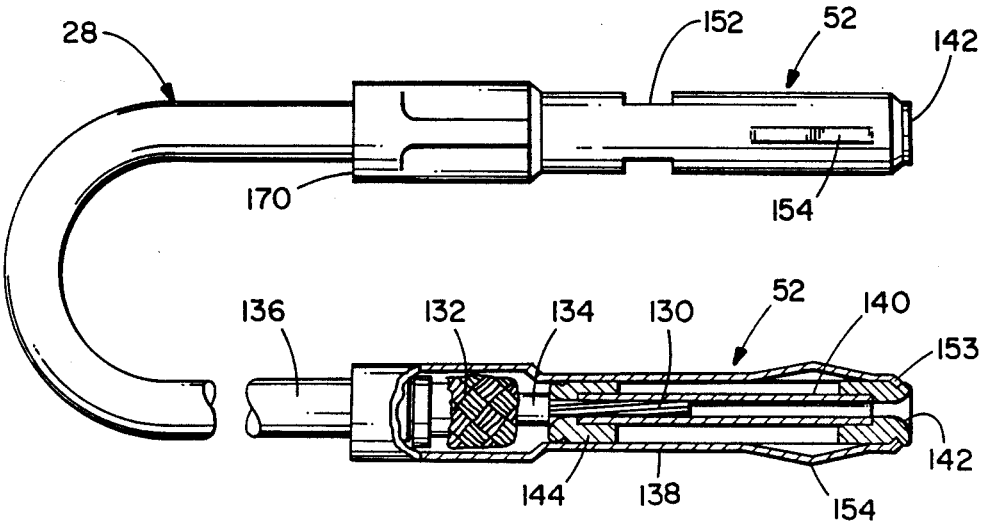
FIG. 11 is a side elevation view, certain parts being cut away and shown in section, to illustrate a coaxial lead and its associated coaxial terminals.

Again, as seen most clearly in FIGS. 6 and 11, each bushing 142, 144 has a generally cylindrical outer surface and an outer diameter substantially the same as the inner diameter of the outer sleeve 138. Each bushing also has a longitudinal bore 146 therethrough and a counterbore 148 (FIG. 6) adapted to fittingly receive an end of the inner sleeve 140. Each bushing 142, 144 also has a funnel shaped entrance 150 generally axial and in communication with the longitudinal bore 146 so as to provide a smooth continuous passage into the interior of the inner sleeve 140.

Suitable dies (not shown) may be operated to crimp the outer sleeve 138 into firm engagement with the outer shield 132. As seen in FIGS. 5, 6, and 11, the outer sleeve 138 has a pair of diametrically opposed windows 152 positioned longitudinally intermediate the bushings 142, 144. The windows enable reception therethrough of radially directed indenting dies (not shown) which are intended to crimp the inner sleeve 140 into fixed engagement with the signal carrying wire 130. Also, at least the bushing 142 has an annular groove 153 formed in its outer surface. The free ends of the outer sleeve 138 are crimped into engagement with the annular groove 153 of the fore bushing 142 in the manner illustrated in FIG. 11 to thereby complete the construction of the terminal 52. For ease of fabrication, it would be preferable for the bushings 142, 144 to be identical even though the groove 153 in the bushing 144 would serve no functional purpose. The outer sleeve 138 may also be provided with a pair of diametrically opposed outwardly bowed fingers 154 intended for engagement with any bore into which it is inserted having a diameter just slightly larger than that of the terminal. Also, it may be desirable to crimp the outer sleeve 138 into engagement with the outer shield 132 and the inner sleeve 140 into engagement with the signal carrying wire 130 at some later time.

Figure 12:
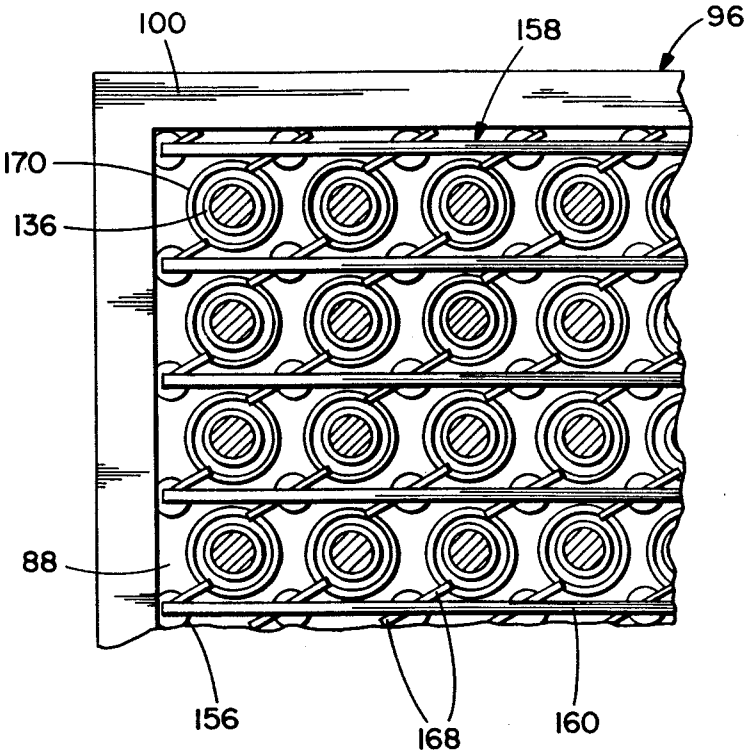
FIG. 12 is a detail plan view illustrating the plug of the construction shown in FIG. 5 in its assembled condition.

Turn now to FIGS. 5 and 12 for the description of a locking mechanism which serves to releasably fix each of the coaxial terminals 52 in its associated terminal receiving bore 94. This locking mechanism serves to assure that all of the extreme ends of the terminals 52 as defined by their fore bushings 142 lie substantially in a common plane spaced from and generally parallel to the front face 90. To this end, each of the dielectric segments 88 has a plurality of locking throughbores 156 therein at spaced locations and generally parallel with the terminal receiving bores 94. An expedient used in conjunction with the locking throughbores 156 is a locking strip 158 which may composed of a stamped metal sheet, although it could also be of molded plastic or other suitable resilient material.

In any event, the locking strip 158 includes an elongated common member 160 and a plurality of elongated locking members 162 integral with the common member and extending transversely therefrom at spaced parallel locations. Each of the locking members 162 includes a central support element 164, which may be rolled to have a diameter slightly larger than that of its associated throughbore 156 so as to be engageable with the rear face 92 when the tail 166 integral with and extending away from the central support element is received in the throughbore. Outwardly and oppositely extending retention barbs 167 are formed near the tip end of each tail 166 and engage the sidewall of the throughbore 156. These serve to temporarily hold the locking strip 158 until it can be permanently mounted to the dielectric segment 88. A pair of resilient locking tabs 168 are integral with and extend away from the central support element 164. In their relaxed locking condition, the locking tabs 166 are intended to be positioned so as to overlie an associated terminal receiving bore 94 adjacent to the tail receiving locking throughbore 156 when the locking strip 158 is in its operative position.

When it is intended that the locking strip 158 is to be fixed onto the dielectric segment 88, the tails 166 are received in their associated locking throughbores 156 such that the central support elements 164 rest on the rear face 92. Thereupon, according to one possible manner of fixation, epoxy or other suitable bonding material is directed into the throughbores 156 so as to fixedly bond the tails 166 to the dielectric segment 88. A plurality of locking strips 158 are thus mounted to the dielectric segment 88 and lie in parallel, spaced apart planes.

As a terminal 52 is inserted into its associated bore 94, the locking tab 168 overlying that particular bore is caused to deflect out of the way to a release position to permit reception by the bore of its associated terminal. However, when the terminal is in its fully inserted position, such that an extreme aft rim 170 of the outer sleeve 138 moves past the tab 168 (FIG. 6), the tab returns to its locking position engageable with the rim 170 to prevent withdrawal of the terminal from its fully inserted position as illustrated. However, it will be appreciated that by manually deflecting the tabs 168, associated terminals 52 can once again be withdrawn from the segment 88. Thus, the locking strip 158 serves to prevent inadvertent removal of a terminal 52 while permitting its withdrawal when specifically intended.

Turn now to FIGS. 3, 4, and 9 for a description of a screw mechanism which serves to releasably fix the frame 96 to the backup plate 22. By reason of this screw mechanism, the ground segments 40 are sandwiched between the backup plate 22 and the dielectric segments 88 resulting in mating engagement of all of the terminals 52 in the plug 36 with associated pin contacts 68 in the receptacles. This screw mechanism includes a jacksocket 172 having a tapped bore fixed to the backup plate 22 and upstanding therefrom. A pair of spaced guide pillars 174 are similarly fixed to the backup plate 22 and are upstanding therefrom at opposed locations spaced from the jacksocket 172. The guide pillars are provided with smooth bores therein rather than the tapped bore of the jacksocket 172. A pair of parallel spaced guide posts 176 are fixed to the frame, specifically, depending from the front side of the two extreme lateral walls 106. The guide posts 176 are slidably received in their associated bores in the guide pillars 174 for properly locating the plug 36 relative to the backup plate 22. A jackscrew 178 is centrally journaled on the major longitudinal wall 102 for rotation about its longitudinal axis which, in turn, is parallel to the axes of the guide posts 176. The jackscrew 178 has threads 180 at one end intended for engagement with the jacksocket 172 and a socket 182 at an opposite end adapted to receive an appropriate tool for rotating the jackscrew.

A handle bar 184 is provided to support the frame 96. As indicated in FIG. 3, the handle bar 184 has three spaced parallel bores (not illustrated) extending transversely therethrough and having parallel longitudinal axes. A central bore is received over the jackscrew 178 and outboard bores are slidably received on the shanks of studs 186 (FIG. 9) and rests on bosses 188, 190 provided on their bases contiguous with the rear side 100 of wall 102. Nuts 192, or other suitable fasteners, are threadedly applied to the studs 186 to thereby fixedly mount the handle bar 184 to the frame 96.

When it comes time to matingly engage the plug 36 with the receptacle 34, the terminals 52 on their associated leads 28 extending from a distant location are inserted into the appropriate bore 94 in the appropriate dielectric segment 88. When all of the bores 94 in all of the segments 88 have received their associated terminals 52, and the terminals are all prevented from inadvertent removal by means of their associated locking strips 158, the backup plate 22 with the logic board 24 thereon is moved toward the frame 96 until the guide posts 176 are slidably received by the internal bores of the guide pillars 174. The threads 180 of the jackscrew 178 are thereby directed into engagement with the jacksocket 172. Simultaneously, each of the alignment pins 128 is caused to seek out its associated alignment bore 44 in the ground segment 40. The floating construction by which the dielectric segments 88 are mounted to the frame 96 permits this end result with a minimum of effort on the part of the user. When all of the alignment pins 128 are received in their associated alignment bores 44, an appropriate tool (not shown) is attached to the socket 182 and turned in order to rotate the jackscrew 178 and tighten the frame 96 on the backup plate 22 with the dielectric segments 88 sandwiched between the frame 96 and the ground segments 40.

The construction used in order to assure proper grounding of the outer sleeve 138 of the terminal 52 will now be described with particular reference to FIGS. 5 and 6. Each of the receiving bores 51 is formed with a counterbore 202 terminating at an annular shoulder 204. A barrel shaped spring 206 which may be formed, for example, of a spring metal stamping rolled into a cylindrical shape and having peripherally spaced engaging members 208 extending into a counterbore 202 is positioned in the counterbore and butted against the annular shoulder 204. The insulation plate 54 engages the end of the barrel shaped spring 206 opposite the shoulder 204 and holds it firmly in place within the counterbore 202. With the plug 36 and receptacle 34 joined together as seen in FIG. 6, each terminal 52 extends through its associated terminal receiving bore 94 in the dielectric segment 88 and into its associated terminal caused to seek out its associated alignment bore 44 in the ground segment 40. The floating construction by which the dielectric segments 88 are mounted to the frame 96 permits this end result with a minimum of effort on the part of the user. When all of the alignment pins 128 are received in their associated alignment bores 44, an appropriate tool (not shown) is attached to the socket 182 and turned in order to rotate the jackscrew 178 and tighten the frame 96 on the backup plate 22 with the dielectric segments 88 sandwiched between the frame 96 and the ground segments 40.

The construction used in order to assure proper grounding of the outer sleeve 138 of the terminal 52 will now be described with particular reference to FIGS. 5 and 6. Each of the receiving bores 51 is formed with a counterbore 202 terminating at an annular shoulder 204. A barrel shaped spring 206 which may be formed, for example, of a spring metal stamping rolled into a cylindrical shape and having peripherally spaced engaging members 208 extending into a counterbore 202 is positioned in the counterbore and butted against the annular shoulder 204. The insulation plate 54 engages the end of the barrel shaped spring 206 opposite the shoulder 204 and holds it firmly in place within the counterbore 202. With the plug 36 and receptacle 34 joined together as seen in FIG. 6, each terminal 52 extends through its associated terminal receiving bore 94 in the dielectric segment 88 and into its associated terminal receiving bore 51 within its associated ground segment 40. The outer sleeve 138 of the terminal 52 engages the barrel shaped spring 206 to thereby assure continuity of ground throughout the length of the lead 28. Simultaneously, the nose end 66 of the signal pin contact 68 is engageably received within the longitudinal bore of the inner sleeve 140 to assure continuity of signal from the logic board 24, through the stripline 30, through the signal pin contact 68, then through the terminal 52, and into the inner wire 130 of the lead 28. By reason of the construction of the terminal 52 as previously described, impedance is maintained substantially constant between the user board 24 and the lead 28.

Turn now to FIGS. 13–16 for the description of another embodiment of the invention. To this end, a modified connector assembly 210 is provided which, as previously, includes a receptacle 212 and a plug 214. The plug 214 is generally similar in construction to the plug 36 except that a frame 216 of the modified plug may be asymmetrically shaped in order to accommodate a pair of aligned dielectric segments 218 which may include one or more rows of coaxial terminals than its neighboring segments 220. As in the previous embodiment, a plurality of threaded fasteners 222 are used to floatingly mount the dielectric segments 218, 220 to the frame 216 in a manner similar to that previously described with the aid of FIG. 10. Also as previously described, the plug may be mounted to a handle bar 224 by means of bolts 226 or in some other suitable fashion.

In the embodiment of FIGS. 13–16, the changes to the receptacle 212 as compared to the receptacle 34 are more pronounced than the changes in the plug 214 as compared with the plug 36. The receptacle 212 utilizes a unitary generally planar metalized grounding block 228 formed with a plurality of spaced parallel terminal receiving bores 230. The grounding block extends to a pair of laterally opposed parallel elongated supporting tongues 232 and a strengthening rib 234 integral with the grounding block extends for the width of the block generally parallel to and midway between fore and aft edges 236, 238, respectively. A jacksocket 240 is an integral part of the strengthening rib 234 intermediate its ends.

Figure 14:
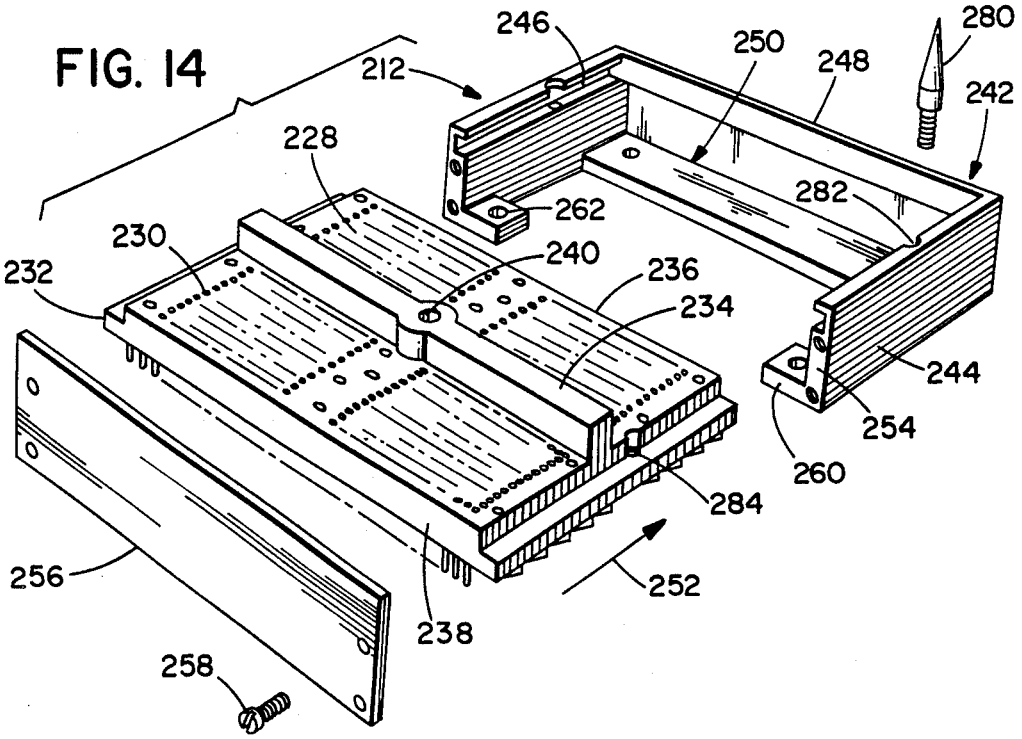
FIG. 14 is an exploded perspective view illustrating a modified receptacle which is one of the components illustrated in FIG. 13.

With continued reference to FIGS. 13 and 14, the receptacle 212 is also seen to include a retainer 242 for supporting the grounding block 228 and suitably affixing it to other structure in a desirable fashion. The retainer 242 includes a pair of spaced apart parallel sidewalls 244 each of which has an elongated slot 246 which extends the length of the sidewalls. The slots 246 are parallel to one another. A first end plate 248 is integral with the sidewalls 244 and extends between and transversely of them. Together, the sidewalls 244 and first end plate 248 define a retention zone 250 for receiving the grounding block 228.

As best seen in FIG. 14, the receptacle 212 is assembled by sliding the grounding block 228 into the retention zone 250. The grounding block and the retainer are so sized and shaped that the supporting tongues 232 are slidably received in the slots 246. The grounding block 228 is then moved in the direction of an arrow 252 until the fore edge 236 is matingly engaged with the first end plate 248. When this occurs, the aft edge 238 of the grounding block 228 is substantially coextensive with extreme ends 254 of the sidewalls 244. Thereupon, a second end plate 256 is mounted to the extreme ends 254 of the sidewalls 244 by means of suitable fasteners 258. In this manner, the grounding block is surrounded and supportively captured by the retainer 242. At least a pair of mounting tabs 260 are provided, integral with each of the sidewalls 244, to enable mounting of the retainer 242 to suitable structure (not shown). For this purpose, each of the mounting tabs 260 is formed with a mounting hole 262 for reception of a suitable fastener (not shown).

Figure 15:
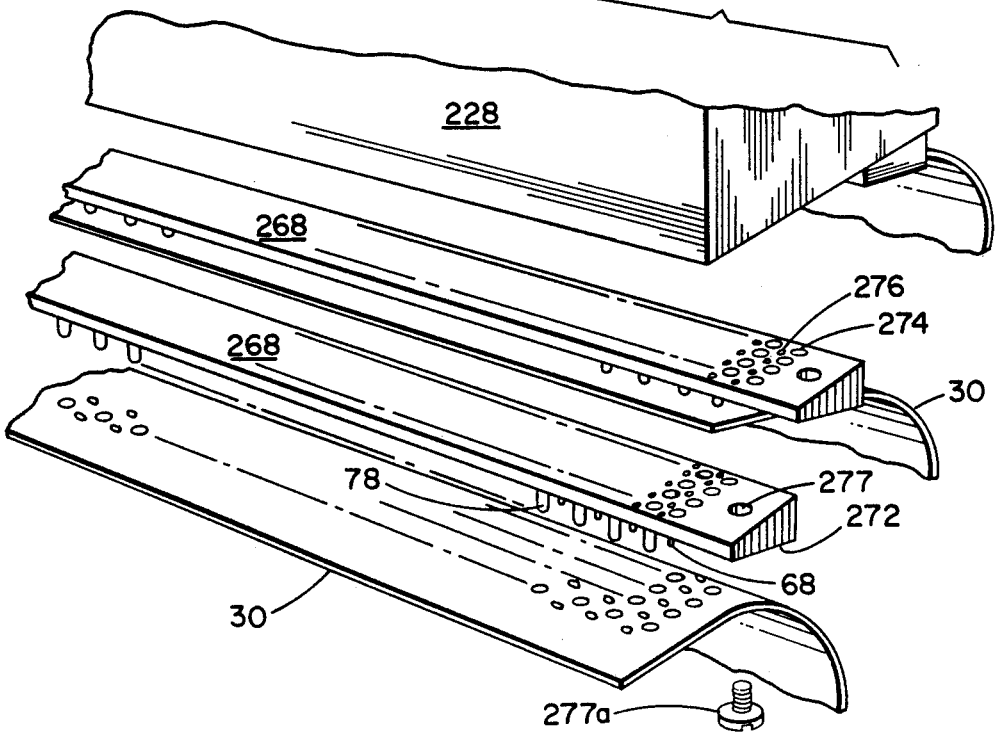
FIG. 15 is a detail exploded perspective view illustrating the manner of terminating stripline cable to one side of the receptacle illustrated in FIG. 14.

Turn now to FIGS. 15 and 16 for a description of the manner of terminating the circuitry on the stripline cable 30 to the receptacle 212 opposite the plug 214. As seen in FIG. 16, the grounding block 228 has a planar face 266 directed away from the side of the receptacle intended for mating engagement with the plug 214. The receptacle 212 further includes a plurality of elongated dielectric strips 268, each of which has a first face 270 intended for coplanar mating engagement with the planar face 266 of the grounding block, and a second face 272 which lies in a plane angularly disposed relative to the first face 270. Thus, a transverse section through each dielectric strip 268 would be generally in the form of a trapezoid.

Each dielectric strip 268 is provided with a plurality of contact receiving bores 274, 276, in a manner similar to the insulation plate 54 of the earlier described embodiment. The bores 274, 276, extend completely through the dielectric strip at a plurality of spaced locations therein. Each bore 274 receives therethrough the nose end 66 of a signal pin contact 68 and is formed with a counterbore in a manner of the counterbore 70 illustrated in FIG. 5 with respect to the insulation plate 54. This counterbore is suitable to fittingly receive the enlarged base 72 intermediate the nose end and the tail 74 of the contact. In a similar manner, the bores 276 serve to receive the ground pin contacts 78.

Each dielectric strip 268 may be fixed to the grounding block in any suitable manner. One construction which is suitable for this purpose might be a clearance bore 277 at spaced locations along the length of the strip and intended to slidably receive a fastener **277*a*** therethrough for threaded engagement with the grounding block. Of course, a variety of other suitable mounting means could be employed.

In the course of a preferred procedure as illustrated in FIG. 15, however, the tails of the signal pin contact 68 and of the ground pin contacts 78 are engaged with appropriate associated apertures in the stripline cable 30 at a location remote from the grounding block 228. At the remote location, the tails of the pin contacts are then soldered to the leads on the stripline cable in a suitable manner thereby completing termination of the stripline cable. Thereupon, the dielectric strip 268 with its associated stripline cable 30 terminated thereat is moved into engagement with the grounding block 228 such that its first face 270 is matingly engaged with the planar face of the grounding block. The dielectric strip 268 is so positioned relative to the grounding block 228 that the contact receiving bores 274, 276 are aligned and in communication with associated terminal receiving bores 230 in the grounding block.

A primary reason for termination of the leads on the stripline cable 30 to the pin contacts 68, 70 at a location remote from the grounding block 228 is to assure that the heat used in the soldering operation is dissipated before the dielectric strip 268 will have been joined to the grounding block. Otherwise, the heat, which may be significant, will be conducted through the ground pin contacts 78 especially and into the grounding block which would thereby undesirably become a heat sink. This heat may have a deleterious effect on other components connected to the grounding block. However, by completing the soldering operation at a location remote from the grounding block, and allowing it to cool before attachment to the grounding block, there is no resulting adverse result to the grounding block and associated components caused by the soldering operation.

In FIG. 16, the dielectric strips 268 are illustrated in side-by-side relationship. Also, each of the second faces 272 is seen to lie in a plane which is parallel to but spaced from the first face of the neighboring dielectric strip. This construction enables termination of a plurality of the stripline cables 30 in a confined location while assuring that the stripline cable terminated to one dielectric strip 268 will not cause harm to or interfere with the pin contacts or stripline cable associated with its neighboring dielectric strip. It is also noteworthy, as most clearly indicated in FIG. 16, that the grounding block 228 occupies only a minor part of the volume of the retention zone 250 and that the major part of the retention zone adjacent the dielectric strips 268 provides for a somewhat protected region for the stripline cable as it extends away from the grounding block 228 and, eventually, through an opening 278 for eventual termination at a distant location.

A pair of alignment pins 280 are illustrated mounted to the grounding block 228 and generally extending perpendicularly therefrom. Suitable cutouts 282 are provided in the inner surfaces of the sidewalls 244 for receiving the alignment pins when their lower threaded portions are threadedly engaged with a suitable threaded bore 284 in the grounding block 228. Thus, one function of the pins 280 is to prevent removal of the grounding block 228 from the receptacle 212. However, a foremost purpose for the alignment pins 280 is for engagement with suitable receiving bores (not shown) formed in the frame 216 to aid in guiding the retainer 242 relative to the frame 216 when the plug and receptacle are drawn together. As this occurs, threads 284 on an extreme end of a socket 286 of a jack screw 288 are caused to engage and draw the plug and receptacle into engagement. In turn, the terminals 52 supported on the dielectric segments 218, 220 are caused to engage with the terminal receiving bores 230 in the grounding block 238 of the receptacle 212 utilizing a construction and in the manner previously described with respect to the embodiment of FIGS. 1–12.

Although there are numerous benefits which flow from the present invention, a primary benefit resides in the construction according to which a very high density of coaxial terminals can be joined in one step to a receiving receptacle while assuring that impedances are matched between each incoming lead and a logic board to which it is ultimately connected.

While a preferred embodiment of the invention has been disclosed in detail, it should be understood by those skilled in the art that various modifications may be made to the illustrated embodiment without departing from the scope as described in the specification and defined in the appended claims.

What is claimed is:

1. A controlled impedance connector assembly comprising:

a receptacle including:

retainer means including:

a pair of spaced apart parallel sidewalls, each of said sidewalls having an elongated slot therein extending the length of its associated said sidewall, each of said slots being parallel; and a first end plate integral with and extending between and transversely of said sidewalls, said sidewalls and said first end plate defining a retention zone;

a generally planar metalized grounding block having a plurality of spaced parallel terminal receiving bores therein and extending between a pair of parallel elongated supporting tongues slidably receivable, respectively, in said slots, said grounding block being substantially coextensive with said retainer means when moved into the retention zone and into engagement with said first end plate;

said retainer means including a second end plate removably mountable to and extending between said sidewalls parallel to said first end plate and engageable with said grounding block whereby said grounding block is supportively captured by said retainer means;

insulation plate means fixed to said grounding block having a plurality of contact receiving bores therein, each in communication with an associated terminal receiving bore in said grounding block; and a plurality of pin contacts fixed to said insulation plate means, each of said pin contacts extending through an associated one of the contact receiving bores therein, each including a head member extending into an associated terminal receiving bore in said grounding block and an oppositely directed tail member for termination at available circuitry; and a plug matingly engageable with said receptacle including:

a plurality of dielectric segments, each having a front face and a rear face and a plurality of parallel spaced terminal receiving bores therein extending from said front face to said rear face;

a plurality of coaxial leads, each including a terminal mounted at an extremity thereof removably fixed in an associated terminal receiving bore of said dielectric segment;

a frame for mounting said dielectric segments as a unit, said frame extending between a front side and a rear side and defining a plurality of compartments therein, each for supportively receiving at least one of said dielectric segments therein, the dimensions of each of said compartments being slightly larger than its associated one of said dielectric segments; and mounting means for mounting said dielectric segments to said frame so as to permit freedom of movement of said dielectric segments relative to said frame within defined limits in directions transverse to the axes of the terminal receiving bores therein;

whereby when said plug is matingly engaged with said receptacle, each of said terminals extends into an associated terminal receiving bore within said grounding block and is fittingly engaged with said grounding block and is coupled to an associated one of said pin contacts, the freedom of movement among said dielectric segments assuring mating engagement of all of said terminals in said plug with the associated terminal receiving bores and with said associated pin contacts of said receptacle.

2. A controlled impedance connector assembly as set forth in claim 1:

wherein said insulating plate means includes:

a plurality of elongated dielectric strips fixed to said grounding block in parallel side by side relationship, each of said dielectric strips having a plurality of contact receiving bores therein, each in communication with an associated terminal receiving bore in said grounding block and each adapted to supportively receive a pin contact therein.

3. A controlled impedance connector assembly comprising:

a receptacle including:

a backup plate;

a metallized grounding block mounted on said backup plate having a plurality of spaced parallel terminal receiving bores therein;

insulation plate means fixed to said grounding block having a plurality of contact receiving bores therein, each in communication with an associated terminal receiving bore in said grounding block; and a plurality of pin contacts fixed to said insulation plate means, each of said pin contacts extending through an associated one of the contact receiving bores therein, each including a head member extending into an associated terminal receiving bore in said grounding block and an oppositely directed tail member for termination at available circuitry; and a plug matingly engageable with said receptacle including:

a plurality of dielectric segments, each having a front face and a rear face and a plurality of parallel spaced terminal receiving bores therein extending from said front face to said rear face;

a plurality of coaxial leads, each including a terminal mounted at an extremity thereof removably fixed in an associated terminal receiving bore of said dielectric segment;

a frame for mounting said dielectric segments as a unit, said frame extending between a front side and a rear side and defining a plurality of compartments therein, each for supportively receiving at least one of said dielectric segments therein, the dimensions of each of said compartments being slightly larger than its associated one of said dielectric segments; and mounting means for mounting said dielectric segments to said frame so as to permit freedom of movement of said dielectric segments relative to said frame within defined limits in directions transverse to the axes of the terminal receiving bores therein;

whereby when said plug is matingly engaged with said receptacle, each of said terminals extends into an associated terminal receiving bore within said grounding block and is fittingly engaged with said grounding block and is coupled to an associated one of said pin contacts, the freedom of movement among said dielectric segments assuring mating engagement of all of said terminals in said plug with the associated terminal receiving bores and with said associated pin contacts of said receptacle.

4. A controlled impedance connector assembly as set forth in claim 3 including:

locking means mounted on each of said dielectric segments for releasably fixing each of said coaxial terminals in its associated terminal receiving bore.

5. A controlled impedance connector assembly as set forth in claim 4:

wherein each of said dielectric segments has a plurality of locking bores therein at spaced locations extending from said front face to said rear face and generally parallel with the terminal receiving bores therein; and wherein said locking means includes:

an elongated locking member having:

a central support element engageable with said rear face;

a tail integral with and extending away from said central support element receivable in an associated locking bore and fixed to said dielectric segment; and a resilient locking tab integral with and extending away from said central support element and, in a relaxed locking position, overlying a terminal receiving bore adjacent to said tail receiving locking bore, said locking tab being deflectable by a terminal to a release position to permit reception thereof into the terminal receiving bore, but returning to its locking position engageable with the terminal to prevent its withdrawal.

6. A controlled impedance connector assembly as set forth in claim 4:

wherein each of said dielectric segments has a plurality of locking bores therein at equally spaced locations extending from said front face to said rear face and generally parallel with the terminal receiving bores therein; and wherein said locking means includes:

a locking strip including:

an elongated common member; and a plurality of elongated locking members integral with said common member and extending transversely therefrom at spaced parallel locations, each of said locking members including:

a central support element engageable with said rear face;

a tail integral with and extending away from said central support element receivable in an associated locking bore and fixed to said dielectric segment; and a pair of resilient locking tabs integral with and extending away from said central support element and, in relaxed locking positions, overlying an associated terminal receiving bore adjacent to said tail receiving locking bore, each of said tabs being deflectable by a terminal to a release position to permit reception thereof into the associated terminal receiving bore, but returning to its locking position engageable with its associated terminal to prevent withdrawal thereof from its associated terminal receiving bore.

7. A controlled impedance connector assembly as set forth in claim 6:

wherein said front and rear faces lie in parallel, spaced apart planes;

wherein each of the terminal receiving bores has a longitudinal axis perpendicular to said front and rear faces;

wherein the plurality of terminal receiving bores in each of said dielectric segments form a matrix of terminal receiving apertures at the intersection thereof with said front and rear faces, the terminal receiving apertures lying in a plurality of mutually perpendicular columns and rows, each of the terminal receiving apertures being equidistant from its neighboring terminal receiving apertures within its associated column and row; and wherein the plurality of locking bores in each of said dielectric segments form a matrix of locking apertures at the intersection thereof with said front and rear faces, the locking apertures lying in a plurality of mutually perpendicular columns and rows, each of the locking apertures being equidistant from its neighboring locking aperture in its associated column and row, each of the locking apertures being equidistant from its neighboring terminal receiving apertures.

8. A controlled impedance connector assembly as set forth in claim 7:

a plurality of said locking strips, each operatively associated with a row of the locking bores, said central support element of each of said locking members being engageable with said rear face and said tail of each of said locking members being fixedly received in an associated locking bore of said dielectric segment.

9. A controlled impedance connector assembly as set forth in claim 6:

retention means for preventing removal of said locking strip from said dielectric segment.

10. A controlled impedance connector assembly as set forth in claim 3:

wherein each of said dielectric segments has a pair of spaced mounting holes therein and associated counterbores defining an annular shelf therebetween; and wherein said frame has a pair of spaced tapped holes therein for mounting of each of said dielectric segments;

wherein said mounting means includes a pair of fasteners, each of said fasteners including:

a shank extending freely through an associated one of the mounting holes;

a head integral with one end of said shank and engageable with said annular shelf;

a threaded end integral with said shank opposite said head, said threaded end having a diameter less than that of said shank to thereby define a shoulder at the interface between said shank and said threaded end, the length of said shank between said head and said shoulder being substantially equal to the thickness of said dielectric segment between said annular shelf and said rear face, said threaded end being threadedly engaged with an associated one of the tapped holes such that when said fastener is tightened so that said shoulder engages said frame, said dielectric segment is substantially immobile in directions parallel to the axes of the terminal receiving bores but has a range of movement relative to said frame in directions transverse to the axes of the terminal receiving bores.

11. A controlled impedance connector assembly as set forth in claim 3:

wherein each of said compartments has interior walls extending between said front side and said rear side; and including:

support means within each of said compartments intermediate said front side and said rear side for engageably receiving parts of said rear faces of associated ones of said dielectric segments such that said front faces of all of said dielectric segments are substantially coplanar.

12. A controlled impedance connector assembly as set forth in claim 3:

wherein each of said compartments has interior walls extending between said front side and said rear side; and including:

a peripheral shelf within each of said compartments intermediate said front side and said rear side for engageably receiving parts of said rear faces of associated ones of said dielectric segments such that said front faces of all of said dielectric segments are substantially coplanar when said rear faces are engaged with said shelf.

13. A controlled impedance connector assembly as set forth in claim 3:

wherein each of said dielectric segments has a pair of spaced mounting holes therein and associated counterbores defining an annular shelf therebetween; and wherein said frame has a pair of spaced tapped holes therein for mounting of each of said dielectric segments;

wherein said mounting means includes a pair of fasteners, each of said fasteners including:

a shank extending freely through an associated one of the mounting holes; a head integral with one end of said shank and engageable with said annular shelf;

a threaded end integral with said shank opposite said head, said threaded end having a diameter less than that of said shank to thereby define a shoulder at the interface between said shank and said threaded end, the length of said shank between said head and said shoulder being substantially equal to the thickness of said dielectric segment between said annular shelf and said rear face, said threaded end being threadedly engaged with an associated one of the tapped holes such that when said fastener is tightened so that said shoulder engages said frame, said dielectric segment is substantially immobile in directions parallel to the axes of the terminal receiving bores but has a range of movement relative to said frame in directions transverse to the axes of the terminal receiving bores.

14. A controlled impedance connector assembly as set forth in claim 13:

wherein said grounding block has a plurality of spaced parallel alignment bores therein; and therein each of said dielectric segments includes a pair of spaced parallel alignment pins extending from said front face for slidable reception with a mating pair of the alignment bores in said grounding block.

15. A controlled impedance connector assembly as set forth in claim 3:

wherein said grounding block includes a plurality of ground segments, each being substantially coextensive with an associated one of said dielectric segments when said plug is matingly engaged with said receptacle, each of said ground segments having a plurality of spaced parallel alignment bores therein; and wherein each of said dielectric segments includes a pair of spaced parallel alignment pins extending from said front face for slidable reception with a mating pair of the alignment bores in said grounding block.

16. A controlled impedance connector assembly as set forth in claim 3 including:

screw means for releasably fixing said frame to said backup plate to thereby maintain mating engagement of all of said terminals with their associated bores in said grounding block and with their associated said pin contacts.

17. A controlled impedance connector assembly as set forth in claim 16 wherein said screw means includes:

a jacksocket having a tapped bore mounted on said backup plate; and a jackscrew threaded at one end and mounted on said frame for rotation about a longitudinal axis, said jackscrew being held against movement in a longitudinal direction, said threaded end being threadedly engaged with the tapped bore of said jacksocket;

whereby rotation of said jackscrew about its longitudinal axis draws said plug into mating engagement with said receptacle.

18. A controlled impedance connector assembly as set forth in claim 17:

wherein said backup plate has a pair of spaced apart guide holes extending therethrough; and wherein said frame includes a pair of parallel spaced guide posts integral therewith and extending away from said front side, said guide posts being slidably received in the guide holes for properly locating said frame relative to said backup plate upon mating engagement of said plug with said receptacle.

19. A controlled impedance connector assembly as set forth in claim 3 wherein said grounding block includes a plurality of ground segments, each being substantially coextensive with an associated one of said dielectric segments when said plug is matingly engaged with said receptacle, each of said ground segments including a bridge member having a pair of spaced parallel alignment bores therein and a pair of spaced apart support legs integral with and extending transversely from said bridge member; and fastener means for mounting said support legs to said backup plate; and wherein each of said dielectric segments includes a pair of spaced parallel alignment pins extending from said front face for slidable reception with the mating pair of the alignment bores in said associated one of said ground segments.

20. A controlled impedance connector assembly as set forth in claim 19 wherein said insulation plate means includes:

an insulation plate fixed to each of said ground segments and contiguous with said bridge member thereof and including a plurality of boss members, each of said boss members defining a contact receiving bore extending therethrough, each of said boss members being fittingly receivable in an associated one of the terminal receiving bores in said ground segment to thereby affix said insulation plate to said ground segment.

21. A controlled impedance connector assembly as set forth in claim 19 wherein said bridge member is planar and is elongated;

wherein said support legs extend from opposite ends of said bridge member; and wherein said insulation plate means includes:

an insulation plate fixed to each of said ground segments, contiguous with said bridge member thereof, and extending between said support legs, said insulation plate including a plurality of boss members, each of said boss members defining a contact receiving bore therethrough, each of said boss members being fittingly receivable in an associated one of the terminal receiving bores in said ground segment to thereby affix said insulation plate to said ground segment.

22. A receptacle as set forth in claim 2 wherein said grounding block has a planar face for engageably receiving said dielectric strips; and wherein each of said dielectric strips has a first face for coplanar mating engagement with said planar face of said grounding block and a second face opposite said first face lying in a plane angularly disposed relative to said first face, said second face adapted to receive stripline cable for mating engagement thereon, said second faces of said plurality of dielectric strips lying in parallel, spaced places thereby enabling termination of a plurality of stripline cables in a confined location.

23. A receptacle as set forth in claim 22 including:

fastening means for mounting each of said dielectric strips on said grounding block.

24. A controlled impedance connector as set forth in claim 3 wherein each of the terminal receiVing bores has a counterbore therein defining an annular ledge; and wherein each of said terminals includes an inner contact member and an outer contact member; and including:

a cylindrical shaped barrel spring member received in each counterbore and having a pair of spaced annular end members peripherally engaged with said grounding block and a plurality of resilient strip members at circumferentially spaced locations extending between said end members, one of said end members being engaged with said annular ledge, each of said strip members being bowed into the central regions of the counterbore for fitting engagement by said outer contact member.

25. A controlled impedance connector assembly as set forth in claim 24 wherein said grounding block and said barrel spring and said outer contact member are all electrically conductive so as to assure electrical continuity between said outer contact member and said grounding block.

26. A controlled impedance connector assembly as set forth in claim 24 wherein said grounding block has first and second spaced surfaces, the bores extending between and communicating with said first and second surfaces, said second surface being adjacent the counterbore; and including:

an insulation plate of dielectric material fixed to said block and contiguous with said second surface, said insulation plate including a plurality of boss members, each of said boss members being receivable into an associated one of the counterbores and fittingly engageable with said annular end member of said barrel spring member distant from said annular ledge.

27. A controlled impedance connector assembly as set forth in claim 19 wherein each of said bridge members has first and second spaced surfaces and a plurality of spaced parallel terminal receiving bores extending therethrough from said first surface to said second surface; and including:

screw means for releasably fixing said frame to said backup plate to thereby maintain mating engagement of all of said terminals with their associated bores in said grounding block and with their associated said pin contacts, said screw means including:

a jacksocket having a tapped bore mounted on said backup plate; and a jackscrew threaded at one end and mounted on said frame for rotation about a longitudinal axis, said jackscrew being held against movement in a longitudinal direction, said threaded end being threadedly engaged with the tapped bore of said jacksocket;

whereby rotation of said jackscrew about its longitudinal axis draws said plug into mating engagement with said receptacle, each of said first surfaces of said bridge members being proximate to an associated one of said front faces of said dielectric segments, said terminal receiving bores in said dielectric segments being aligned with said terminal receiving bores in said bridge members.

28. A controlled impedance connector assembly as set forth in claim 27 wherein said bridge member is planar and is elongated;

wherein said support legs extend from opposite ends of said bridge member; and wherein said insulation plate means includes:

an insulation plate fixed to each of said ground segments, contiguous with said bridge member thereof, and extending between said support legs, said insulation plate including a plurality of boss members, each of said boss members defining a contact receiving bore therethrough, each of said boss members being fittingly receivable in an associated one of the terminal receiving bores in said ground segment to thereby affix said insulation plate to said ground segment.

* * * * *